US008555579B2

(12) United States Patent
Zlatar

(10) Patent No.: US 8,555,579 B2
(45) Date of Patent: Oct. 15, 2013

(54) AIR TIGHT ACCESS FLOOR ASSEMBLY

(75) Inventor: Peter Zlatar, Seven Hills (AU)

(73) Assignee: Peter Zlatar, Seven Hills, New South Wales (AU)

( * ) Notice: Subject to any disclaimer, the term of this patent is extended or adjusted under 35 U.S.C. 154(b) by 336 days.

(21) Appl. No.: 12/738,917

(22) PCT Filed: Aug. 4, 2008

(86) PCT No.: PCT/AU2008/001122
§ 371 (c)(1),
(2), (4) Date: Apr. 20, 2010

(87) PCT Pub. No.: WO2009/052545
PCT Pub. Date: Apr. 30, 2009

(65) Prior Publication Data
US 2010/0205874 A1 Aug. 19, 2010

(30) Foreign Application Priority Data
Oct. 22, 2007 (AU) ..... 2007231620

(51) Int. Cl.
*E04B 5/48* (2006.01)
*E04B 5/43* (2006.01)

(52) U.S. Cl.
CPC ..... *E04B 5/43* (2013.01)
USPC ..... 52/263

(58) Field of Classification Search
USPC ..... 52/126.1, 126.5, 126.6, 126.7, 263
See application file for complete search history.

(56) References Cited

U.S. PATENT DOCUMENTS

| | | | | | |
|---|---|---|---|---|---|
| 3,279,134 | A * | 10/1966 | Donovan | 52/126.6 |
| 3,318,057 | A | 5/1967 | Norsworthy | |
| 3,396,501 | A * | 8/1968 | Tate | 52/263 |
| 3,425,179 | A * | 2/1969 | Haroldson | 52/126.6 |
| 3,616,584 | A * | 11/1971 | Sartori et al. | 52/126.6 |
| 3,899,857 | A * | 8/1975 | Mochizuki | 52/126.6 |
| 4,685,258 | A | 8/1987 | Av-Zuk | |
| 4,893,441 | A * | 1/1990 | Catalano et al. | 52/126.6 |
| 5,791,096 | A * | 8/1998 | Chen | 52/263 |
| 6,519,902 | B1 * | 2/2003 | Scissom | 52/263 |
| 2012/0090252 | A1 * | 4/2012 | Zlatar | 52/126.6 |

FOREIGN PATENT DOCUMENTS

| | | | |
|---|---|---|---|
| AU | 2006200759 | B | 2/2006 |
| DE | 3913984 | A1 | 11/1989 |
| EP | 353360 | B1 | 10/1993 |
| FR | 2050197 | A3 | 4/1971 |
| GB | 1054411 | | 1/1963 |
| WO | 02/11260 | A2 | 2/2002 |
| WO | 2005042874 | A1 | 5/2005 |

OTHER PUBLICATIONS

International Search Report dated Sep. 18, 2008.
Derwent Abstract Accession No. 96-113678/12, Class Q45, JP 08013759 A (Matsushita Electric Works Ltd) Jan. 16, 1996.
Derwent Abstract Accession No. 2002-275896/32, Class Q45;T04 JP 2002047786 A (Ahresty Corp) Feb. 15, 2002.
International European Search Report dated Oct. 21, 2010.

* cited by examiner

*Primary Examiner* — Mark Wendell
*Assistant Examiner* — Matthew J Smith
(74) *Attorney, Agent, or Firm* — Cooper Legal Group, LLC

(57) ABSTRACT

An air tight panel support assembly for an access floor having a plurality of panels (12) includes a pedestal (60) for supporting at least one panel of the access floor, and a stringer (66) supported by the pedestal. In use, the stringer (66) extends from one pedestal to another pedestal and supports the underside edges of adjacent panels (12) so as to close any gap therebetween.

9 Claims, 6 Drawing Sheets

AIR TIGHT ACCESS FLOOR ASSEMBLY

FIELD OF INVENTION

The present invention relates to access flooring and, in particular, to an air tight panel support assembly for an access floor.

BACKGROUND OF INVENTION

Access flooring is a common feature of many computer, media and communication rooms. Being raised above a concrete slab or other sub-floor by pedestals, access flooring provides underlying space to conceal and arrange cabling and other service items used to operate the computers or other interactive equipment located within the room. The space beneath access flooring also allows air to distribute therethrough in a manner that can be controlled, say, by underfloor air conditioning systems, thus assisting to control the temperature of the room. Access flooring also provides some degree of noise attenuation and vibration dampening properties desirable in an office environment.

The interconnecting panels which define the surface of an access floor are designed to be readily taken up and rearranged, upon prior removal of any overlying carpet or other floor coverings, when upgrading of the computers and other interactive equipment is required. The panels, as well as the pedestals which support them, also need to withstand, and provide long-term stability against, considerable static and dynamic loads.

Although, by and large, most access flooring performs well, an unacceptable level of noise may still be created when the metal to metal contacting components of each pedestal are subject to relative movement, say, through their expansion or contraction arising from temperature variation, or by movement of a load thereon.

These contacting metal components of each pedestal also allow vibration to be readily conducted therethrough, with the result that any vibration sensitive component of the computers and other interactive equipment may be subject to gradual diminution of its effectiveness or failure. A sensation of walking on a hard floor, and the lower leg strain that may arise from walking thereon for extended periods, are a further result of having all components of the pedestal being readily conductive to vibration. The vibrations generated by the impact shock of foot steps are reflected back from the sub-floor to the feet walking on the access floor.

The aforementioned noise and vibration related problems have been addressed in the inventor's earlier Australian Patent No. 2006 200 759, incorporated herein by reference.

However, in providing a pedestal for an access floor that creates a slight separation between adjacent edges of adjacent panels sufficient to prevent transmission of noise and vibration therebetween, the gaps so created between the panels allow any pressurised air in the underfloor space to escape or leak into the room. Such leakage of pressurised air also occurs in earlier access flooring where the panels supported by pedestals were not intended to have a slight separation therebetween.

This is a particular concern as underfloor air conditioning systems are becoming increasingly popular given their greater energy efficiency over conventional air conditioning systems. Any leakage of pressurised air between the panels reduces the desired pressure of conditioned air in the underfloor space and leads to less effective release of air conditioned air at desired locations through the floor where optimal air conditioning of the room is sought.

SUMMARY OF INVENTION

It has been found by the present inventor that the problem of leakage of pressurised air between the panels of an access floor may be substantially overcome by providing a pedestal that can support a stringer, the stringer extending from one pedestal to another pedestal and supporting the underside edges of adjacent panels so as to close any gap therebetween.

In one broad form of the invention, there is provided an air tight panel support assembly for an access floor having a plurality of panels, the assembly comprising a pedestal for supporting at least one panel of the access floor, and a stringer supported by the pedestal, wherein, in use, the stringer extends from one pedestal to another pedestal and supports the underside edges of adjacent panels so as to close any gap therebetween.

Preferably, the assembly comprises first and second pedestals for supporting a panel at respective first and second corners of the panel, and the stringer is supported at a first end thereof by the first pedestal and at a second end thereof by the second pedestal.

It is preferred that each of the first and second pedestals include a slot and each of the first and second ends of the stringer include a clip for releasably engaging a respective slot.

Alternatively, each of the first and second pedestals may include a clip and each of the first and second ends of the stringer may include a slot for releasably engaging a respective clip.

Preferably, the assembly comprises a plurality of pedestals for supporting every panel of the access floor, and each pedestal is adapted to support four panels at respective corners of each of the panels, and support four stringers at respective ends thereof.

In a preferred form, each stringer has sealing material at its upper side for providing an air tight seal against the underside edges of adjacent panels.

Each stringer is preferably formed as a substantially U-shaped channel between the clip at the first end and the clip at the second end thereof.

In a further preferred form, the pedestal includes:

(a) a stand portion having
  (i) a base plate for resting upon a sub-floor, and
  (ii) a metal stem extending upwardly therefrom,
(b) a head portion having
  (i) a platform for receiving thereon an edge region of one or more panels that define the surface of the access floor, and
  (ii) a metal shaft extending downwardly therefrom, and
(c) an isolator sleeve means having noise attenuation and vibration dampening properties, and being adapted to fit longitudinally between overlapping portions of the metal stem and the metal shaft to thereby isolate the stem from contact with the shaft.

Preferably, the platform comprises a cruciform boss extending upwardly from a circular support plate.

It is preferred that the head portion further includes a cruciform divider panel having noise attenuation and vibration dampening properties, the panel being adapted to be secured upon the cruciform boss, whereby it may receive thereupon the edge region of one or more panels.

The cruciform divider panel preferably has raised cruciform ribbing thereon, and the corners of a panel of the access floor are adapted to fit against the corresponding sides of any two perpendicularly arranged ribs of the raised cruciform ribbing.

In a preferred form, the pedestal includes four slots, the openings of which are sunk below the cruciform divider panel so that, when a clip of a stringer releasably engages any one of the slots, the stringer is flush mounted on the pedestal.

According to another aspect of the invention, there is provided an access floor including an air tight panel support assembly described above and a plurality of panels supported thereby.

SUMMARY OF DRAWINGS

In order that the invention may be more readily understood and put into practical effect, reference will now be made to the accompanying drawings, in which:—

DETAILED DESCRIPTION OF A PREFERRED EMBODIMENT

Figure 1:
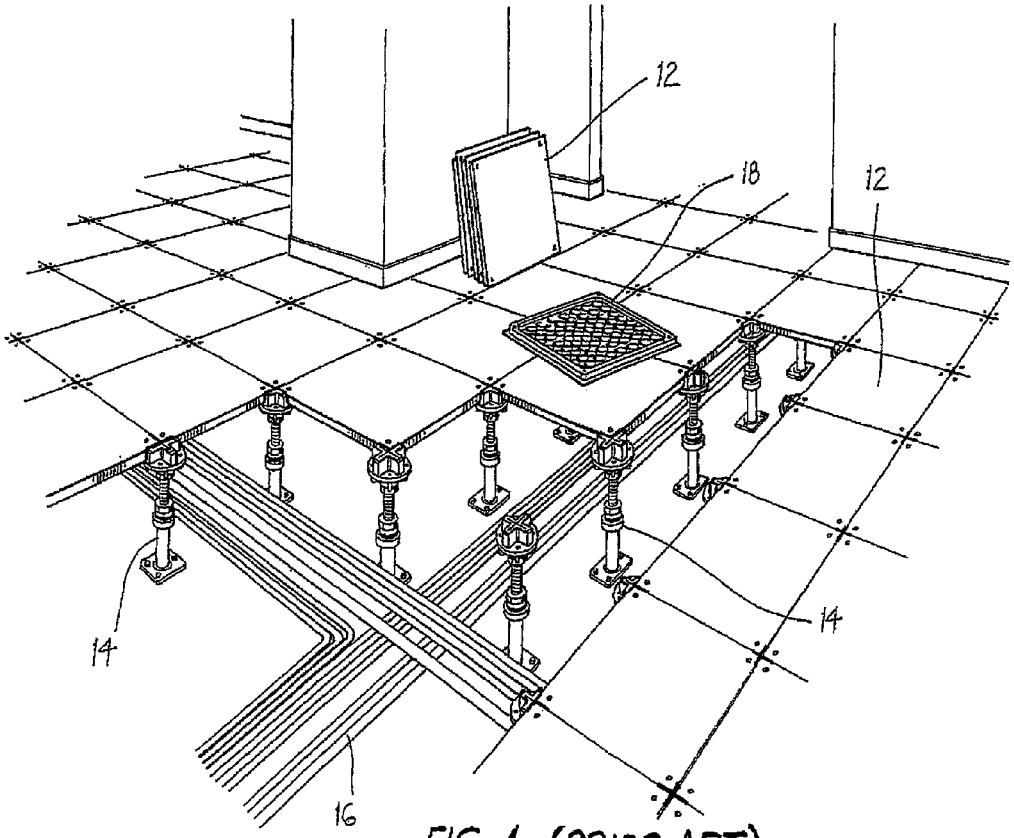
FIG. 1 (PRIOR ART)
FIG. 1 is a perspective view of an access floor of the prior art in which some of the panels thereof have been taken up to reveal the supporting pedestals according to earlier Australian Patent No. 2006 200 759.
Figure 3:
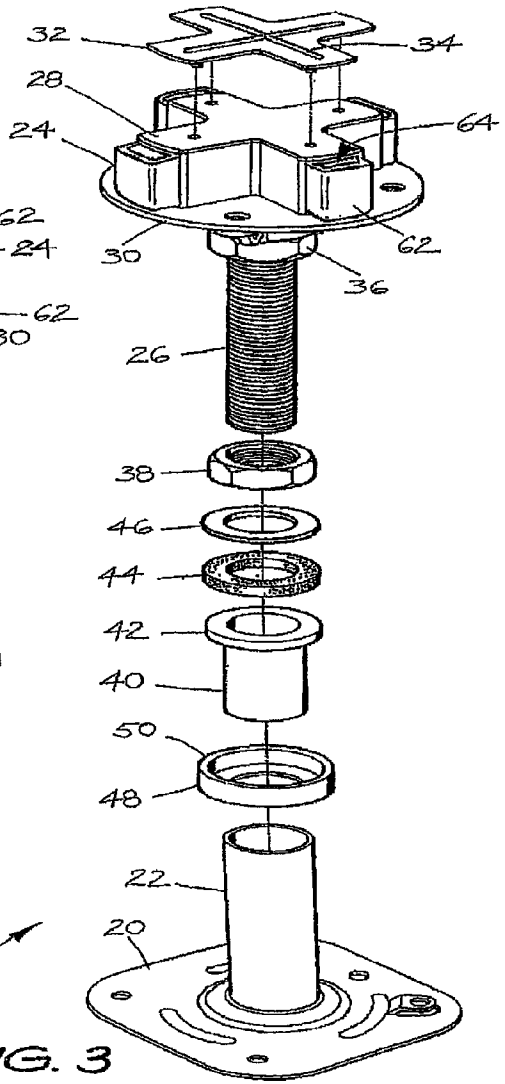
FIG. 3 is a perspective view of the pedestal shown in FIG. 2 when disassembled into its component parts.
Figure 2:
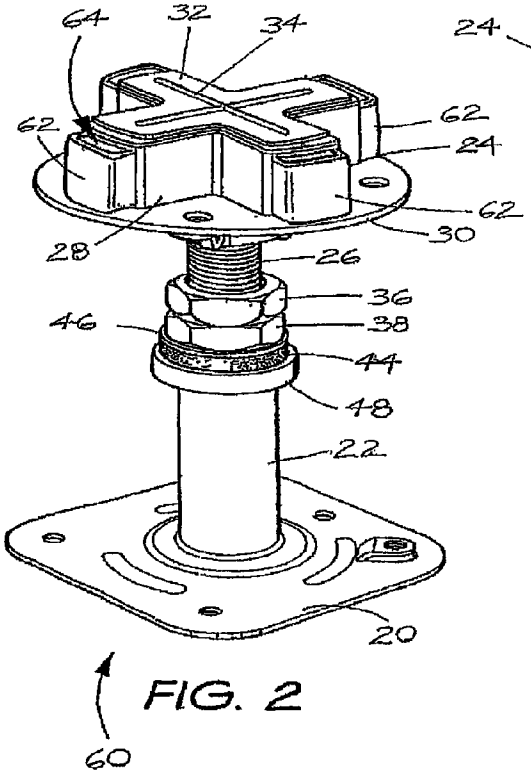
FIG. 2 is a perspective view of a pedestal according to a preferred embodiment of the invention.
Figure 4:
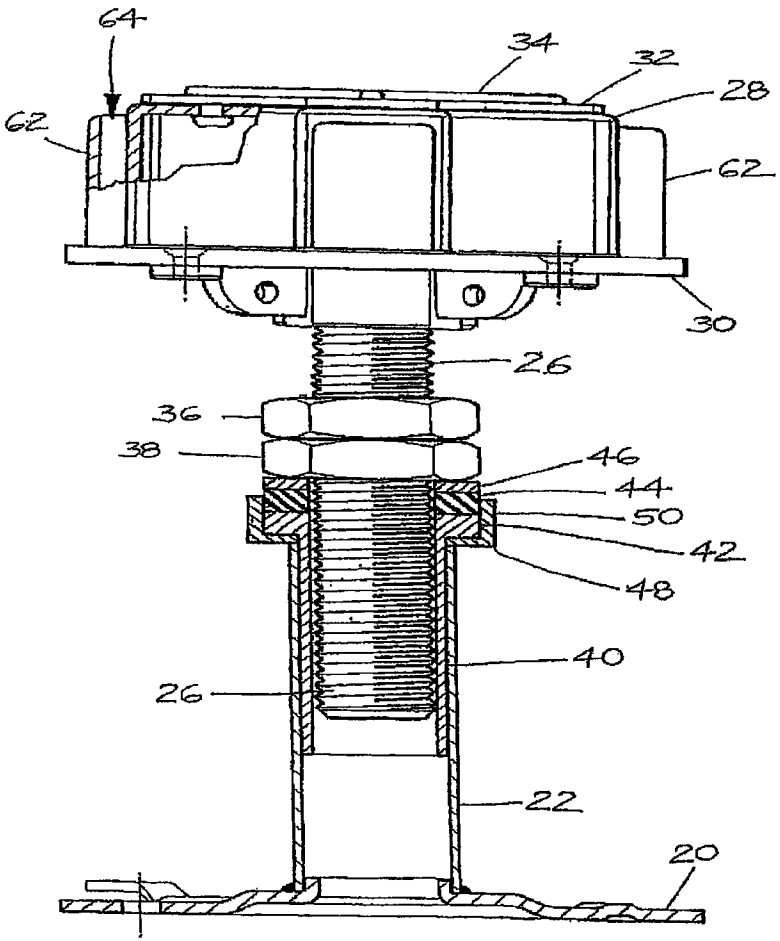
FIG. 4 is part sectional side view of the pedestal shown in FIG. 2.

The access floor of the prior art shown in FIG. 1 has raised floor surface panels 12 supported by pedestals 14 resting upon a sub-floor, with telecommunications cabling 16 also shown in the space underlying the panels 12. The pedestals 14 are those described in the inventor's earlier Australian Patent No. 2006 200 759.

The floor panels 12 used in the access floor of the prior art are in the form of steel cementitious floor panels of 600 mm length by 600 mm width having an outer steel welded construction with an enclosed bottom pan 18 formed with a uniform pattern of generally hemispherical pockets. The cementitious material that fills the welded steel jacket of each panel 12 is lightweight and has some degree of noise attenuation properties.

The floor panels, to which reference will hereinafter be made for the purpose of describing the preferred embodiment of the present invention, are structurally identical to the floor panels 12, and will also be numbered identically.

The preferred pedestal 60 of the present invention shown in FIGS. 2 to 8 broadly comprises a stand portion, a head portion and isolator sleeve means.

In this broad form, the stand portion comprises a base plate 20 for resting upon the sub-floor, and a metal stem 22 extending upwardly therefrom.

In this embodiment, the base plate 20 is made of metal and is substantially square shaped with rounded corners. The stem 22 is a hollow cylindrical tube and is welded centrally to the base plate 20.

Figure 6:
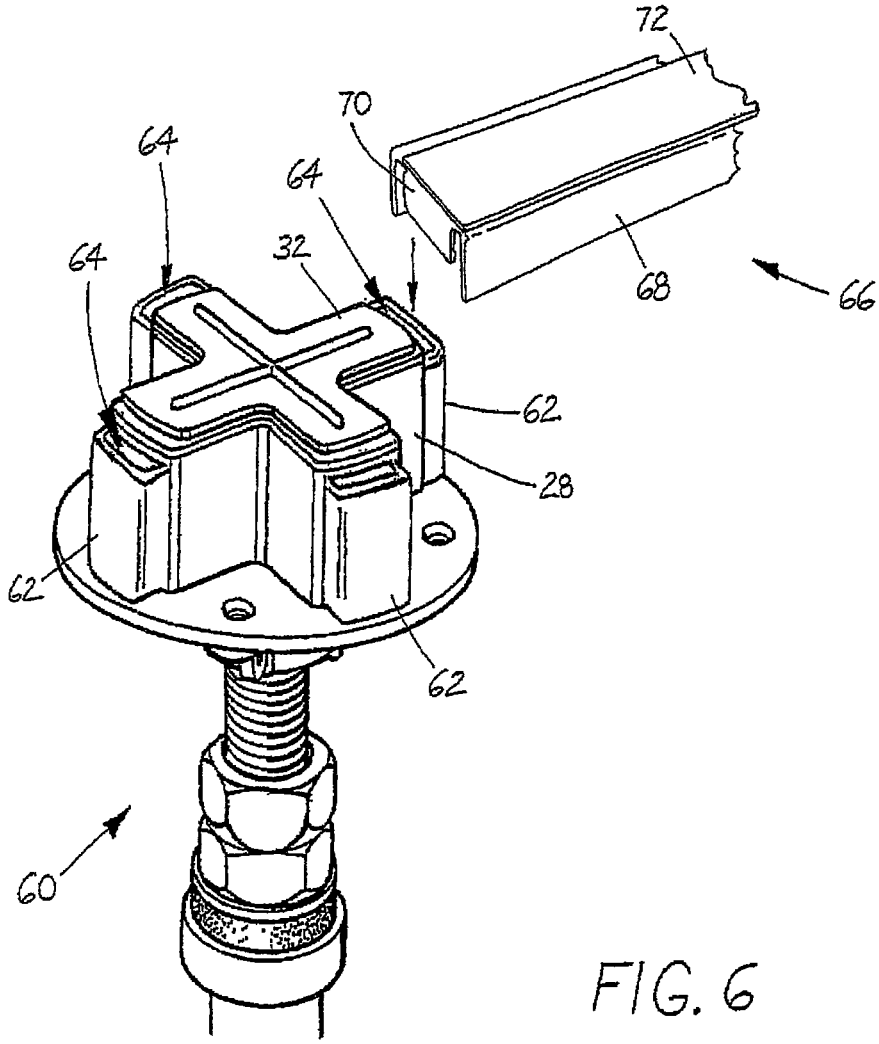
FIG. 6 is a perspective view of a top part of the pedestal shown in FIG. 2 alongside an end of a stringer which is adapted to be supported by the pedestal.
Figure 7:
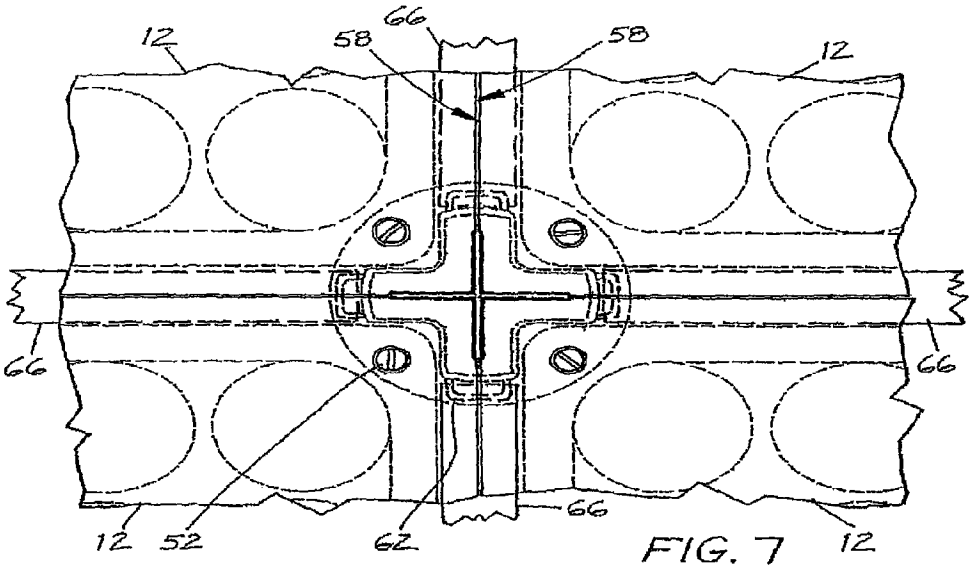
FIG. 7 is a plan view of a portion of an access floor resulting from the interconnection of the panels shown in FIG. 5 with the pedestal and with four stringers of the kind shown in FIG. 6.
Figure 8:
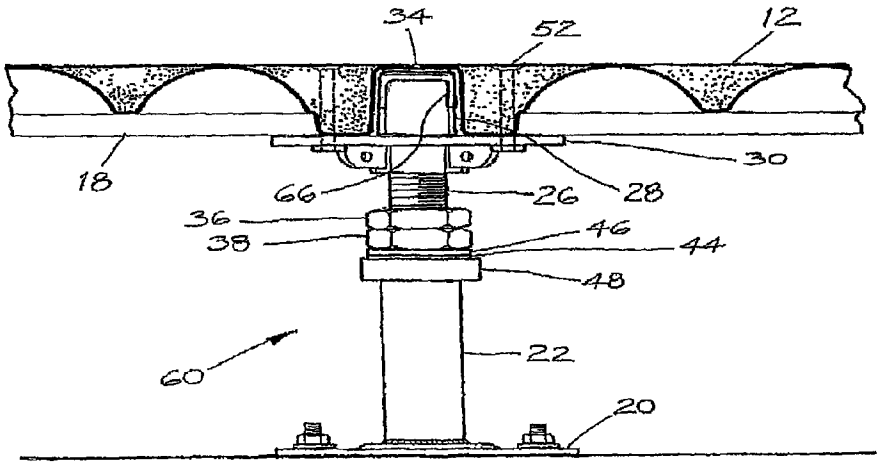
FIG. 8 is a side view of the portion of the access floor shown in FIG. 7.

In this broad form, the head portion comprises a platform 24 for receiving thereon an edge region of one or more of the panels 12, and a metal shaft 26 extending downwardly therefrom. In this embodiment, the platform 24 comprises a metal, cruciform boss 28 extending upwardly from a metal, circular support plate 30. There is a plastic cruciform divider panel 32 having noise attenuation and vibration dampening properties that is engaged to the uppermost surface of the cruciform boss 28. The divider panel 32 has raised cruciform ribbing 34 thereon. Extending outwardly from each of the four arms of the cruciform boss 28 is a slotted seat 62 that defines a slot 64. Each of the slots 64, as will be described later with regard to FIGS. 6, 7 and 8, is adapted to receive a clip of a stringer. When so received, the pedestal and stringer define an air tight panel support assembly for an access floor. The shaft 26 of the head portion is threaded and screwably engages first and second nuts 36, 38. The first nut 36 serves as a locking nut, and the second nut 38 serves as an adjusting nut. The platform 24 of the head portion has a threaded aperture (not shown) at its underside and within which the top of the shaft 26 is screwably engaged. The platform 24 is made by die casting.

In this broad form, the isolator sleeve means, in use, fits longitudinally between overlapping portions of the metal stem 22 and the metal shaft 26 so as to isolate the stem 22 from contact with the shaft 26. The isolator sleeve means has noise attenuation and vibration dampening properties. In this embodiment, the isolator sleeve means comprises a plastic sleeve member 40 that fits longitudinally through the metal stem 22, and the metal shaft 26 fits longitudinally through the plastic sleeve member 40. The top surface of the sleeve member 40 is defined by an annular, outwardly extending, flange portion 42. There is a rubber isolator ring 44 through which the shaft 26 fits so that a bottom surface of the isolator ring 44 locates against a top surface of the flange portion 42 of the plastic sleeve member 40. There is also a plastic isolator ring 46 through which the shaft 26 fits so that a bottom surface of the plastic isolator ring 46 locates against a top surface of the rubber isolator ring 44. The rubber isolator ring 44, in particular, has significant noise attenuation and vibration dampening properties.

In this embodiment, the pedestal 60 further includes a metal cup 48 having a central opening and an annular upright wall 50. The plastic sleeve member 40 is fitted through the central opening of the cup 48 until the flange portion 42 of the plastic sleeve member 40 fits snugly alongside (and is surrounded by) the annular upright wall 50. The diameter of the central opening of the cup 48 is equal to that of the stem 22 and so the cup 48 cannot fit over the stem 22 but is located upon the top edge defining the opening of the stem.

The height of the pedestal 60 is determined by the location of the second nut 38 along the shaft 26, as the second nut 38 adjusts the extent to which the stem 22 overlaps the shaft 26.

The plastic isolator ring 46, rubber isolator ring 44, plastic sleeve member 40, and metal cup 48 are sandwiched between the second nut 38 and the top edge of the stem 22, and they are then locked in their respective fitted locations through pressure applied thereon by downwardly screwing the first nut 36 against the second nut 38.

The preferred stringer 66 of the present invention shown in FIGS. 6, 7 and 8 comprises a substantial U-shaped channel 68, which may be made of metal, with a clip 70 at a first end thereof and another clip (not shown) at a second end thereof. As shown in FIG. 6, clip 70 is able to releasably engage slot 64 of a slotted seat 62 of pedestal 60, thereby allowing the pedestal 60, to support the stringer 66. Soft sealing material 72, which may be foam like, is affixed to the upper side of the stringer 66. The sealing material 72 is adapted to provide an air tight seal against the underside edges of adjacent panels of the access floor when the stringer is in use. The slots 64 have openings which are sunk below the cruciform divider panel 32 so that, when engaged, the stringer 66 is flush mounted on the pedestal 60.

In order to assemble the access floor, pedestals 60 are appropriately located on a sub-floor in order to support the raised floor panels 12, and stringers 66 are then appropriately located so as to be supported on the pedestals 60 in the manner described above, and to extend from one pedestal to another pedestal.

Figure 5:
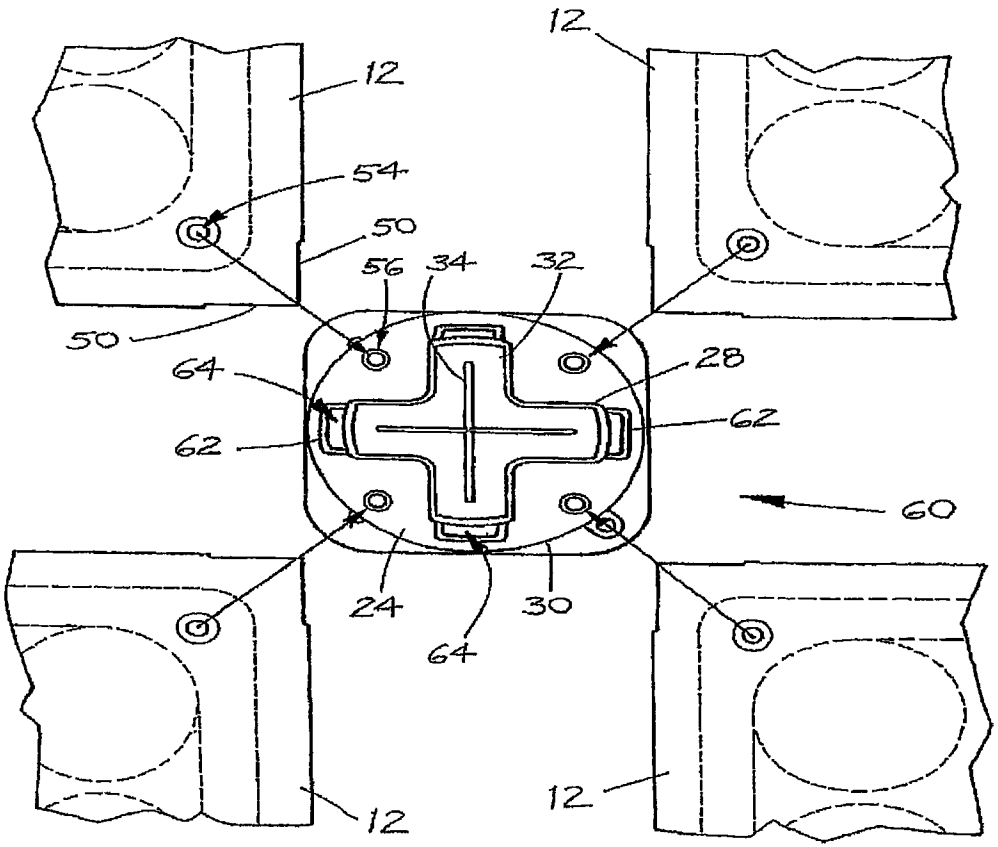
FIG. 5 is a plan view of the pedestal shown in FIG. 2 alongside corner portions of panels of an access floor which are adapted to be supported by the pedestal.

The floor panels 12 are then located so that an edge region, in the form of a corner, of each of four such panels 12 is received on the platform 24 of the pedestal 60 (as shown in FIG. 5), and the underside edges of adjacent panels are supported on a stringer 66 so as to close any gap therebetween (as shown in FIGS. 7 and 8). Specifically, each corner has cutaway or stepped edges 50 that meet perpendicularly and are adapted to fit against the corresponding sides of any two perpendicularly arranged ribs of the raised cruciform ribbing 34 of the divider panel 32 that is secured upon the cruciform boss 28. When so fitted, bolts 52 are applied through overlapping screw holes 54, 56 formed near the corners of each panel 12 and through the circular support plate 30 of the pedestal 60, and the bolts 52 are then engaged by nuts for tightly securing the corner of each panel 12 to the pedestal 60. As shown in FIG. 7, the adjacent edges 58 (other than the cutaway edges 50) of adjacent panels 12 are slightly separated sufficiently to prevent transmission of noise and vibration therebetween, but the gap created thereby is closed by the stringer 66, thereby preventing any leakage into the room of pressurised air between the panels from the underfloor space.

It will be apparent from the above description that the pedestal and stringer that define an air tight panel support assembly of the present invention have an advantage over access floor pedestals of the prior art in that they, not only create a reduced level of noise and have improved vibration dampening properties, but they prevent any leakage into the room of pressurised air between the panels from the underfloor space.

Persons skilled in the art will readily appreciate that various modifications may be made in details of design and construction of the air tight panel support assembly for an access floor described above without departing from the scope or ambit of the invention.

The invention claimed is:

1. An air tight panel support assembly for an access floor having a plurality of floor panels, the assembly comprising first and second pedestals for supporting a floor panel at respective first and second corners of the panel, each pedestal including a head portion having a platform upon which a corner of the panel is received, a stringer supported at a first end thereof by the first pedestal and at a second end thereof by the second pedestal, wherein the stringer has sealing material at its upper side for providing an air tight seal against the underside edges of adjacent floor panels, and the stringer is formed as a substantially U-shaped channel between a clip at the first end and a clip at the second end thereof, and wherein the platform comprises a cruciform boss and a cruciform divider panel having noise attenuation and vibration dampening properties, the divider panel being secured upon the cruciform boss, whereby the divider panel receives thereupon the corner of one or more floor panels such that the floor panel simultaneously engages the stringer at the edge of the floor panel and the cruciform divider panel at the corner of the floor panel, each of the first and second ends of the stringer includes said clip for releasably engaging a respective slot and that the slots are formed in the head portion of the pedestals and the openings of the slots are sunk below the cruciform divider panel so that, when a clip of a stringer releasably engages any one of the slots, the stringer is flush mounted on the pedestal such that the upper side of the stringer is flush with the cruciform divider panel to define a generally planar surface.

2. The air tight panel support assembly of claim 1 wherein the cruciform boss has four arms and each slot is defined by a slotted seat which extends outwardly from a respective arm of the cruciform boss.

3. The air tight panel support assembly of claim 2, wherein the slotted seat extends outwardly from an end of one of the respective arms of the cruciform boss.

4. The air tight panel support assembly of claim 3, wherein the slot defined by the slotted seat is positioned outwardly from the end of one of the respective arms of the cruciform boss.

5. The air tight panel support assembly of claim 1 wherein the cruciform boss extends upwardly from a support plate of the head portion.

6. The air tight panel support assembly of claim 1 wherein the cruciform divider panel has raised cruciform ribbing thereon, the ribbing being configured so that the corner of a floor panel can fit against the corresponding sides of any two perpendicularly arranged ribs of the raised cruciform ribbing.

7. An access floor including an air tight panel support assembly of claim 6 and a plurality of floor panels supported thereby, and wherein each corner of a floor panel has cutaway edges that meet perpendicularly and are configured to fit against the corresponding sides of the two perpendicularly arranged ribs of the raised cruciform ribbing.

8. The air tight panel support assembly of claim 1 wherein each pedestal further includes:

(a) a stand portion having;
  (i) a base plate for resting upon a sub-floor, and
  (ii) a metal stein extending upwardly therefrom,
(b) a metal shaft extending downwardly from the platform of the head portion, and
(c) an isolator sleeve means having noise attenuation and vibration dampening properties, and configured to fit longitudinally between overlapping portions of the metal stem and the metal shaft to thereby isolate the stem from contact with the shaft.

9. An access floor including an air tight panel support assembly of claim 1 and a plurality of floor panels supported thereby.

* * * * *